US009166277B2

(12) United States Patent
Yang et al.

(10) Patent No.: US 9,166,277 B2
(45) Date of Patent: Oct. 20, 2015

(54) INTEGRATED ANTENNA ASSEMBLY

(75) Inventors: Songnan Yang, San Jose, CA (US); Xintian E. Lin, Mountain View, CA (US); Anand S. Konanur, Sunnyvale, CA (US); Seong-Youp Suh, Portland, OR (US); Ulun Karacaoglu, San Diego, CA (US)

(73) Assignee: Intel Corporation

( * ) Notice: Subject to any disclaimer, the term of this patent is extended or adjusted under 35 U.S.C. 154(b) by 1013 days.

(21) Appl. No.: 12/975,537

(22) Filed: Dec. 22, 2010

(65) Prior Publication Data

US 2012/0162024 A1 Jun. 28, 2012

(51) Int. Cl.

| | |
|---|---|
| ***H01Q 1/24*** | (2006.01) |
| ***H01Q 1/22*** | (2006.01) |
| ***H01Q 9/04*** | (2006.01) |

(52) U.S. Cl.

CPC ..... *H01Q 1/2275* (2013.01); *H01Q 9/0421* (2013.01)

(58) Field of Classification Search

USPC ..... 343/702

See application file for complete search history.

(56) References Cited

U.S. PATENT DOCUMENTS

| | | | | |
|---|---|---|---|---|
| 6,885,880 | B1 * | 4/2005 | Ali | 455/575.7 |
| 2008/0158063 | A1 * | 7/2008 | Zeng et al. | 343/700 MS |
| 2008/0231495 | A1 * | 9/2008 | Yang et al. | 342/46 |
| 2010/0265150 | A1 * | 10/2010 | Arvidsson et al. | 343/837 |

FOREIGN PATENT DOCUMENTS

EP 1693925 A1 * 8/2006

OTHER PUBLICATIONS

"Antenna Frequency Scaling," The ARRL Antenna Book, 1988. pp. 2-24 to 2-25.*

* cited by examiner

*Primary Examiner* — Graham Smith

(74) *Attorney, Agent, or Firm* — Alpine Technology Law Group LLC

(57) ABSTRACT

An antenna assembly comprises a computer expansion card comprising a metallic layer which forms a radiating element or a metallic shield which forms the radiating element and a feed line coupled to the radiating element. Other embodiments may be described.

16 Claims, 8 Drawing Sheets

INTEGRATED ANTENNA ASSEMBLY

RELATED APPLICATIONS

None.

BACKGROUND

The subject matter described herein relates generally to the field of electronic communication and more particularly to antenna assemblies which may be used in electronic devices.

Many electronic devices such as notebook and laptop computers, personal digital assistants (PDAs), and the like include one or more wireless transceivers to send and receive data via wireless networks. Multi-mode devices, which can transceiver data on multiple different wireless networks, may share hardware, e.g., transmitters, receivers, antennas, etc., in order to reduce both the cost and size of a device. Accordingly, integrated antenna assemblies, and particularly antenna assemblies which may be used on multiple networks, may find utility.

BRIEF DESCRIPTION OF THE DRAWINGS

The detailed description is described with reference to the accompanying figures.

DETAILED DESCRIPTION

In the following description, numerous specific details are set forth to provide a thorough understanding of various embodiments. However, it will be understood by those skilled in the art that the various embodiments may be practiced without the specific details. In other instances, well-known methods, procedures, components, and circuits have not been illustrated or described in detail so as not to obscure the particular embodiments.

Figure 1A:
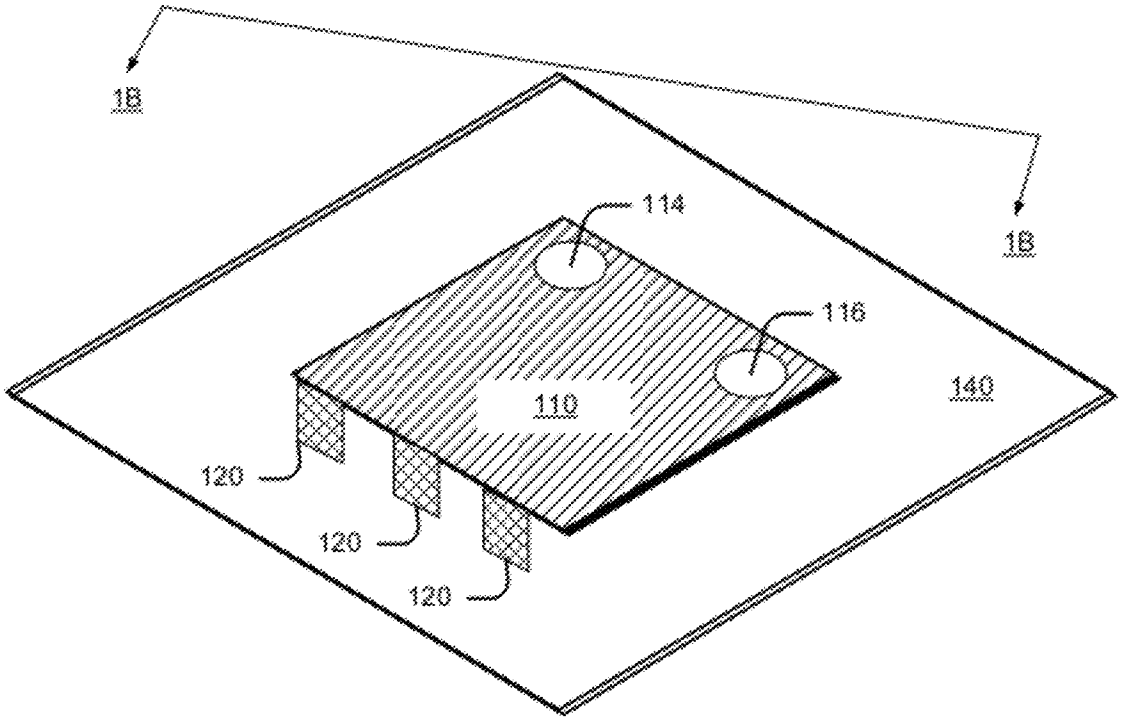
FIGS. 1A-1C are schematic illustrations of a circuit board assembly comprising an integrated antenna assembly according to some embodiments.
Figure 1B:
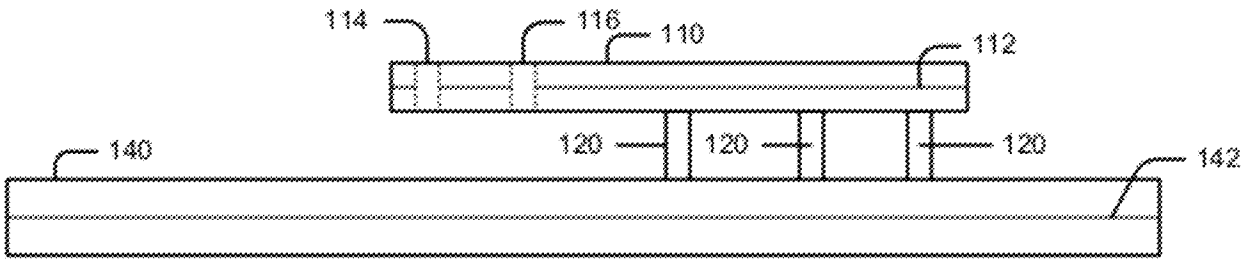
Figure 1C:
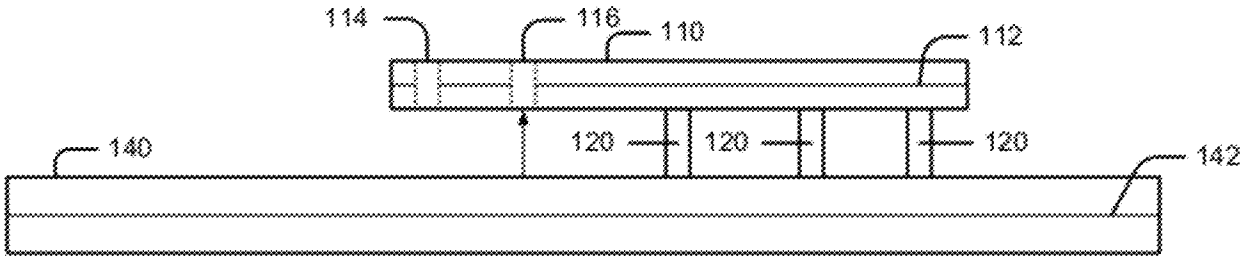

FIGS. 1A-1C are schematic illustrations of a circuit board assembly comprising an integrated antenna assembly according to some embodiments. Referring to FIGS. 1A-1C, in some embodiments the circuit board assembly comprises a motherboard 140. The particular configuration of the motherboard 140 is not critical. In some embodiments the motherboard 140 may be configured as a motherboard for an electronic device, e.g., a computer system, a mobile communication device, or the like. Motherboard 140 may comprise various circuitry and expansion slots to accommodate plug-in devices such as, e.g., integrated circuits, memory devices, and the like.

An antenna assembly 100 is mounted on motherboard 140. In some embodiments the antenna assembly 110 may comprise a computer expansion card. By way of example, in some embodiments the computer expansion card 110 may comprise a peripheral component interconnect express (PCI-E) half-mini card (HMC), although other cards may be used.

In some embodiments the computer expansion card 110 may be mounted adjacent the motherboard 140 by a suitable fastener via one or more mounting holes 114, 116 disposed at respective corners of the computer expansion card 110. Further, computer expansion card 110 comprises a plurality of grounding pins 120 to provide a connection to ground plane 142 via the motherboard 140.

In embodiments in which the computer expansion card 110 is embodied as a PCI-E half-mini card the computer expansion card measures approximately 31.90 millimeters (mm) in length by 30.0 mm in width and 1.00 mm in thickness. In alternate embodiments the computer expansion card 110 may measure between 30.00 and 60.00 mm in length and 25.0 and 35.0 mm in width, and up to 5.0 mm in thickness. The computer expansion card 110 may comprise an array of contacts or pins disposed along an edge to establish electrical contact with corresponding pins or contacts in a socket coupled to the motherboard 140.

Referring now to FIGS. 1B and 1C, in some embodiments the computer expansion card 110 may be embodied as a multi-layer card which comprises at least one layer defining a radiating element 112. Radiating element 112 may be implemented as a substantially planar layer of electrically conductive metal. In the embodiment depicted in FIGS. 1A-1C the radiating element 112 extends across substantially the entire area of the computer expansion card 110. In alternate embodiments the radiating element 112 may extend across only a portion of the area of computer expansion card 112. In alternate embodiments, the radiating element may comprise a metallic shielding attached to the computer expansion card 110, either on the top or bottom of the computer expansion card 110. The radiating element 112 may comprise a first part which is a printed layer and a second part which is extended to the shield through metallic contact.

At least a portion of the motherboard 140 comprises a layer which defines a ground plane 142 for the antenna assembly 100. In the embodiment depicted in FIGS. 1B-1C the ground plane 142 extends throughout the entire area of the motherboard 142. However, it will be appreciated that the ground plane 142 need not cover the entire area of the motherboard 140.

One skilled in the art will recognize that the radiating element 112 of the computer expansion card 110 and the ground plane 142 of the motherboard 140 along with ground pins 120 model a planar inverted F antenna (PIFA) structure. The ground pins 120 provide grounding for the antenna structure and the ground plane 142 in the motherboard 140 functions as the antenna ground plane. As illustrated in FIG. 1C, in use an RF signal may be fed into the antenna via one of the mounting holes 114, 116 to the ground plane on the mother board, while leaving the other not electrically connected to the mother board ground. In the embodiment depicted in FIG. 1C the RF signal is fed via mounting hole 116, but one skilled in the art will recognize that either mounting hold could be used. The RF signal could be driven directly from radio on the HMC or other sources. The signal is connected to pad(s) near the mounting hole either on top or bottom of the HMC. A metallic screw can be used to mount the card to the mother board, also providing metallic contact between the signal pad near the hole and the ground plane of the mother board. Other ways of connecting the signal pad to the ground plane of mother board can also be used, such as making contact between the metallic stud on the mother board to the signal pad on bottom or both top and bottom.

Figure 2:
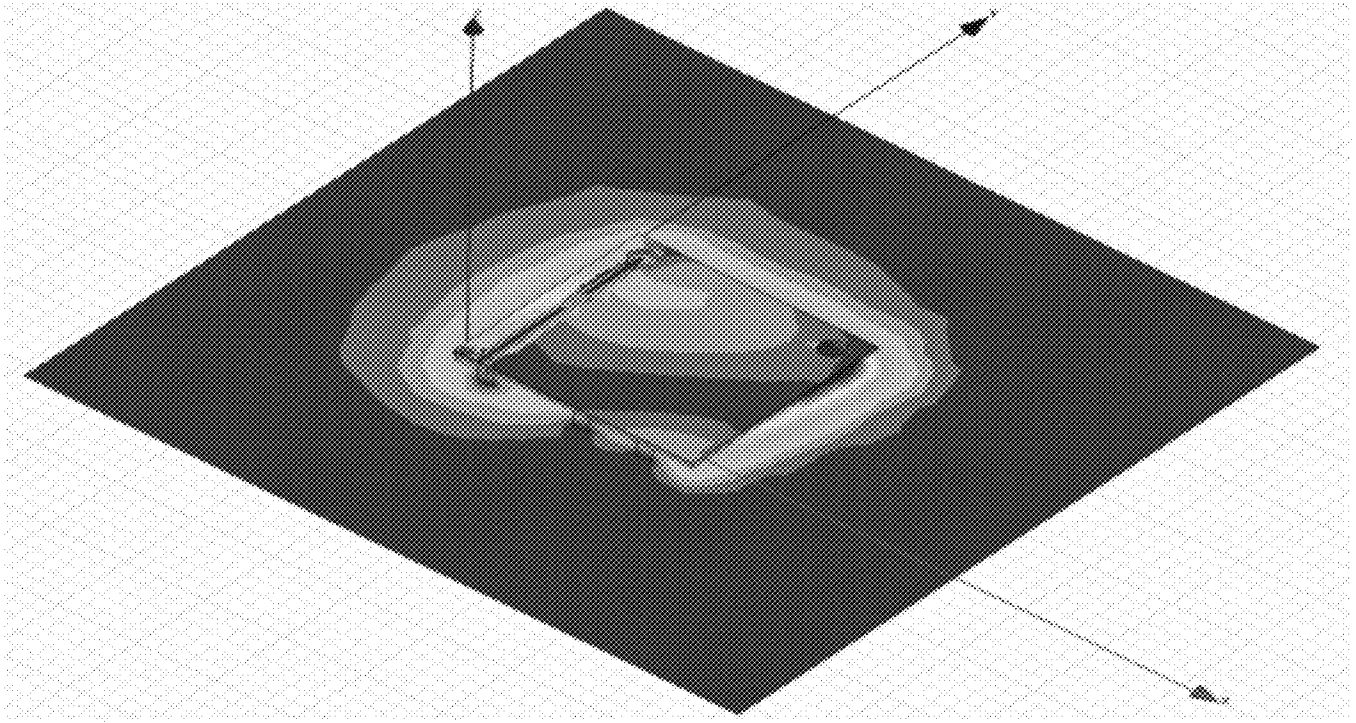
FIG. 2 is a schematic illustration of the electric field distribution of an integrated antenna assembly, according to some embodiments.

The resonance frequency of the antenna assembly 100 is a function of the size of the radiating element 112 and the impedance matching of the antenna assembly 100 at the resonance frequency is a function of the location of the feed point and the grounding pins. In embodiments in which the radiating element 112 extends across substantially the entire area of the computer expansion card 110 the antenna assembly exhibits a natural resonance frequency centered approximately at 2.5 GHz. This is illustrated in FIG. 2, which is a schematic illustration of the electric field distribution of an integrated antenna assembly 100, according to some embodiments.

Figure 3:
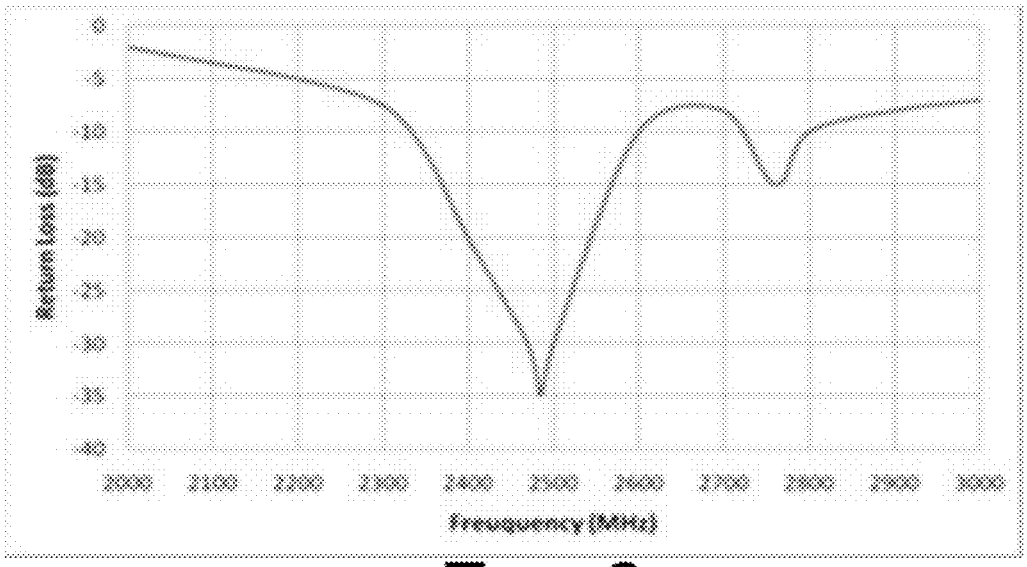
FIG. 3 is a graph illustrating the return loss of an integrated antenna assembly, according to some embodiments.
Figure 4:
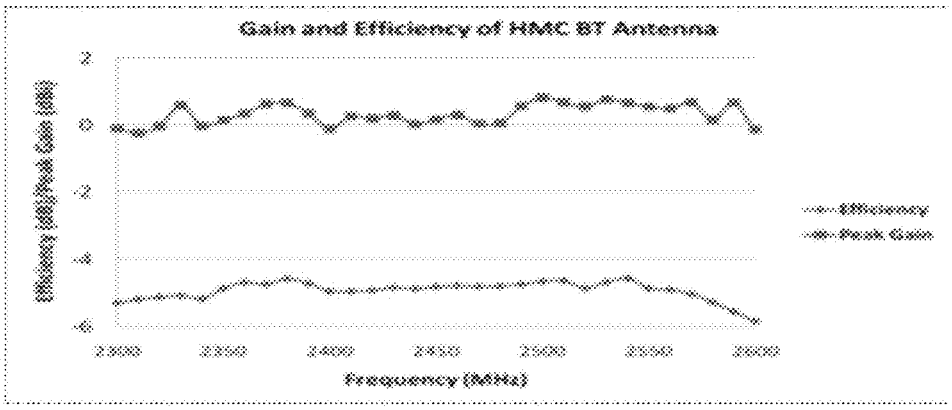
FIG. 4 is a graph illustrating efficiency and peak gain performance for an integrated antenna assembly, according to some embodiments.

FIG. 3 is a graph illustrating the return loss of an integrated antenna assembly 100, according to some embodiments. Referring to FIG. 3, the antenna assembly 100 exhibits a return loss better than −15 dB across the 2.4 GHz ISM band, and a return loss better than −10 dB across the frequency spectrum from 2.35 GHz to 2.6 GHz. FIG. 4 is a graph illustrating efficiency and peak gain performance for an integrated antenna assembly, according to some embodiments. As illustrated in FIG. 4, the antenna assembly provides strong, consistent gain and efficiency across the frequency spectrum from 2.35 GHz to 2.6 GHz.

Figure 5A:
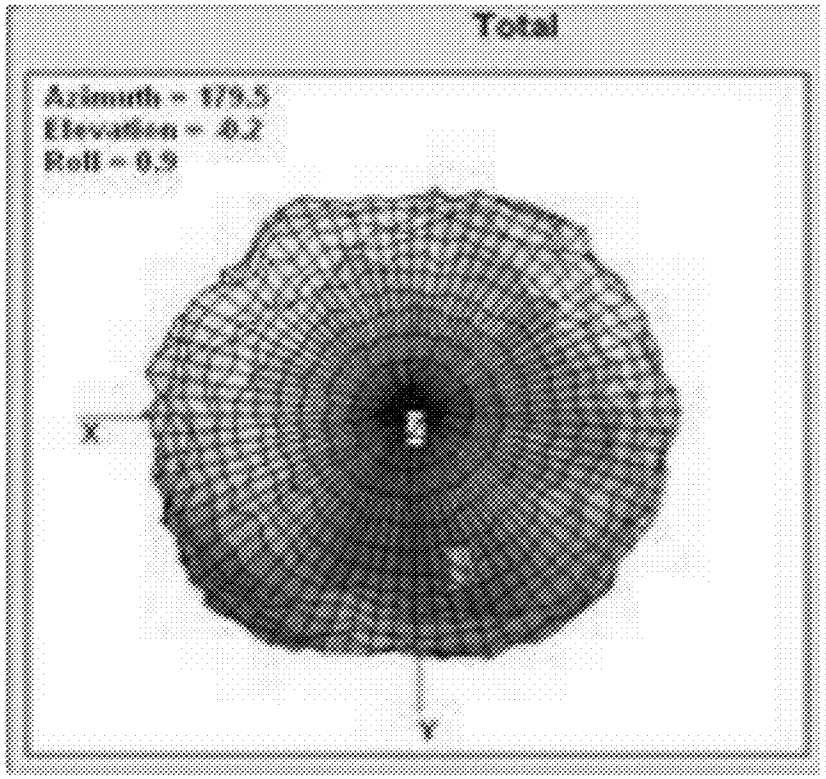
FIGS. 5A and 5B are schematic illustrations of top and side views, respectively, of radiation patterns for an integrated antenna assembly, according to some embodiments.
Figure 5B:
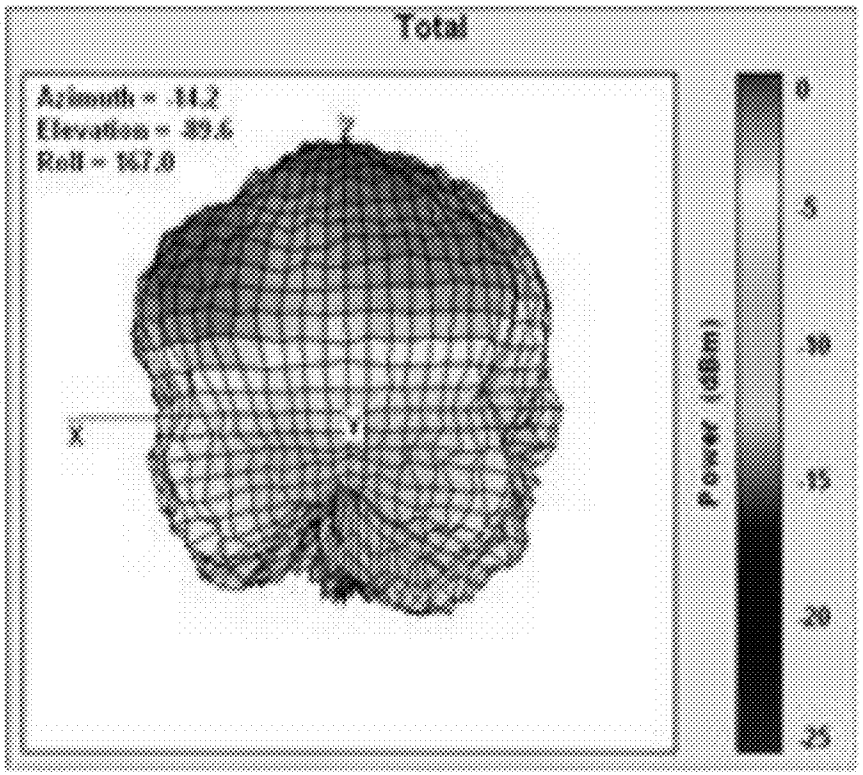

FIGS. 5A and 5B are schematic illustrations of top and side views, respectively, of radiation patterns for an integrated antenna assembly 100, according to some embodiments. As illustrated in FIGS. 5A and 5B, the antenna assembly 100 exhibits a near-uniform, omni-directional radiation pattern.

One skilled in the art will recognize that an antenna assembly 100 with the performance characteristics illustrated in FIGS. 2-5 is suitable for use in multimode devices, e.g., as an antenna structure for both WiFi networks operating in the 2.4 GHz frequency spectrum and Bluetooth networks operating in the 2.4 GHz frequency spectrum region.

Figure 6:
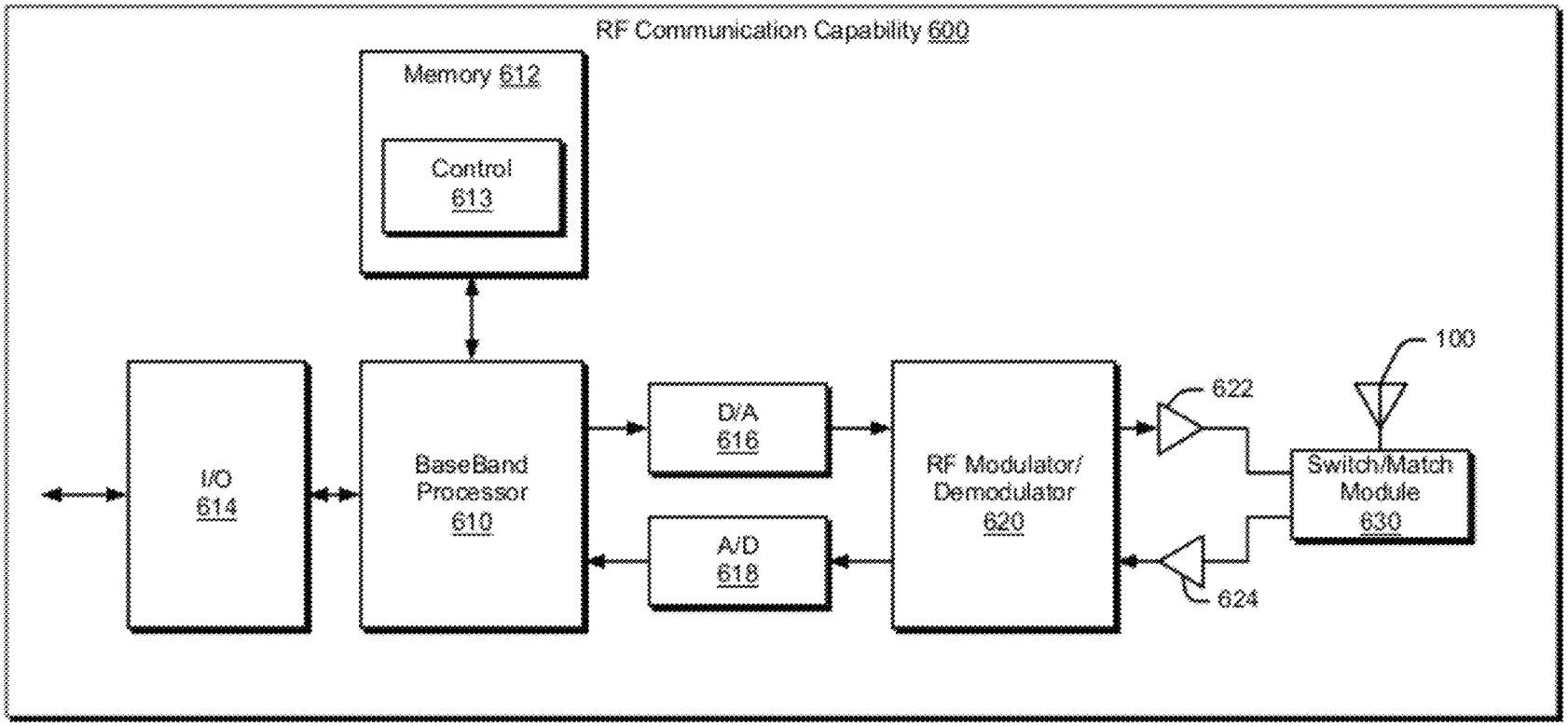
FIG. 6 is a schematic illustration of an RF communication capability which may be integrated into an electronic device, according to embodiments.

In some embodiments the antenna assembly 100 may be incorporated into the RF communication capability 600 of an electronic device. Referring now to FIG. 6, a block diagram of an RF communication capability 600 in accordance with one or more embodiments will be discussed. FIG. 6 depicts the major elements of an RF communication capability 600, however fewer or additional elements may be included in alternative embodiments in addition to various other elements that are not shown herein, and the scope of the claimed subject matter is not limited in these respects.

RF communication capability 600 may comprise a baseband processor 610 coupled to memory 612 for performing the control functions of RF communication capability. Input/output (I/O) block 614 may comprise various circuits for coupling RF communication capability to one or more other devices or components of an electronic device. For example, I/O block 614 may include one or more Ethernet ports and/or one or more universal serial bus (USB) ports for coupling RF communication capability 600 to a modem or other devices. For wireless communication, RF communication capability 600 may further include a radio-frequency (RF) modulator/demodulator 620 for modulating signals to be transmitted and/or for demodulating signals received via a wireless communication link.

A digital-to-analog (D/A) converter 616 may convert digital signals from baseband processor 610 to analog signals for modulation and broadcasting by RF modulator/demodulator 620 via analog and/or digital RF transmission techniques. Likewise, analog-to-digital (A/D) converter 618 may convert analog signals received and demodulated by RF modulator/demodulator 620 digital signals in a format capable of being handled by baseband processor 610. Power amplifier (PA) 622 transmits outgoing signals via one or more antennas 628 and/or 630, and low noise amplifier (LNA) 624 receives one or more incoming signals via antenna assembly 100, which may be coupled via switching and matching module 630 to control such bidirectional communication. In one or more embodiments, RF communication capability 600 may implement single input, single output (SISO) type communication, and in one or more alternative embodiments RF communication capability may implement multiple input, multiple output (MIMO) communications, although the scope of the claimed subject matter is not limited in these respects.

Figure 7:
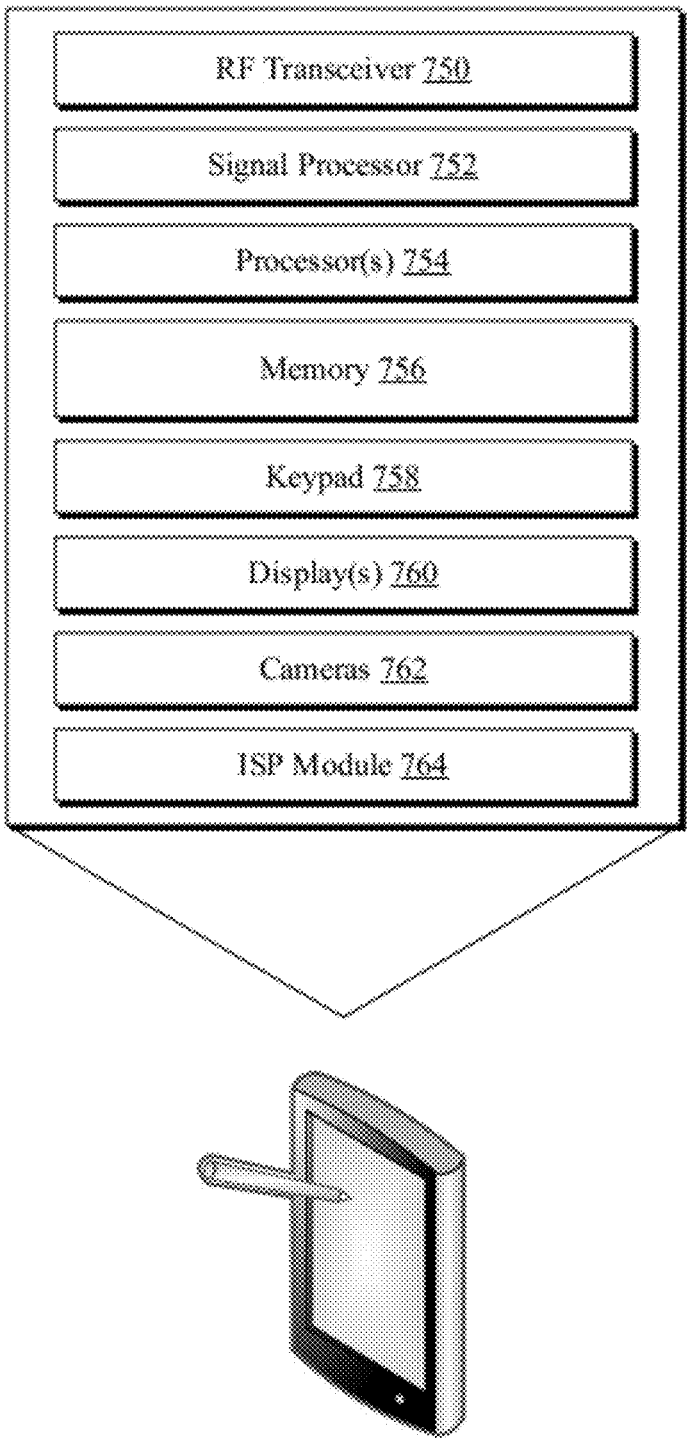
FIG. 7 is a schematic illustration of an electronic device which includes a wireless communication capability, according to some embodiments.

FIG. 7 is a schematic illustration of an electronic device 716 which includes a wireless communication capability, according to some embodiments. Referring to FIG. 7, in some embodiments electronic device 716 may be embodied as a mobile telephone, a personal digital assistant (PDA), a laptop computer, or the like. Electronic device 716 may include an RF transceiver 750 to transceive RF signals and a signal processing module 752 to process signals received by RF transceiver 750.

RF transceiver 750 may implement a local wireless connection via a protocol such as, e.g., Bluetooth or 802.11x. IEEE 802.11a, b or g-compliant interface (see, e.g., IEEE Standard for IT-Telecommunications and information exchange between systems LAN/MAN—Part II: Wireless LAN Medium Access Control (MAC) and Physical Layer (PHY) specifications Amendment 4: Further Higher Data Rate Extension in the 2.4 GHz Band, 802.11G-2003). Another example of a wireless interface would be a general packet radio service (GPRS) interface (see, e.g., Guidelines on GPRS Handset Requirements, Global System for Mobile Communications/GSM Association, Ver. 3.0.1, December 2002).

Electronic device 716 may further include one or more processors 754 and a memory module 756. As used herein, the term "processor" means any type of computational element, such as but not limited to, a microprocessor, a microcontroller, a complex instruction set computing (CISC) microprocessor, a reduced instruction set (RISC) microprocessor, a very long instruction word (VLIW) microprocessor, or any other type of processor or processing circuit. In some embodiments, processor 754 may be one or more processors in the family of Intel® PXA27x processors available from Intel® Corporation of Santa Clara, Calif. Alternatively, other CPUs may be used, such as Intel's Itanium®, XEON™, ATOM™, and Celeron® processors. Also, one or more processors from other manufactures may be utilized. Moreover, the processors may have a single or multi core design. In some embodiments, memory module 756 includes random access memory (RAM); however, memory module 756 may be implemented using other memory types such as dynamic RAM (DRAM), synchronous DRAM (SDRAM), and the like.

Electronic device 716 may further include one or more input/output interfaces such as, e.g., a keypad 758 and one or more displays 760. In some embodiments electronic device 716 comprises one or more camera modules 762 and an image signal processor 764.

Figure 8:
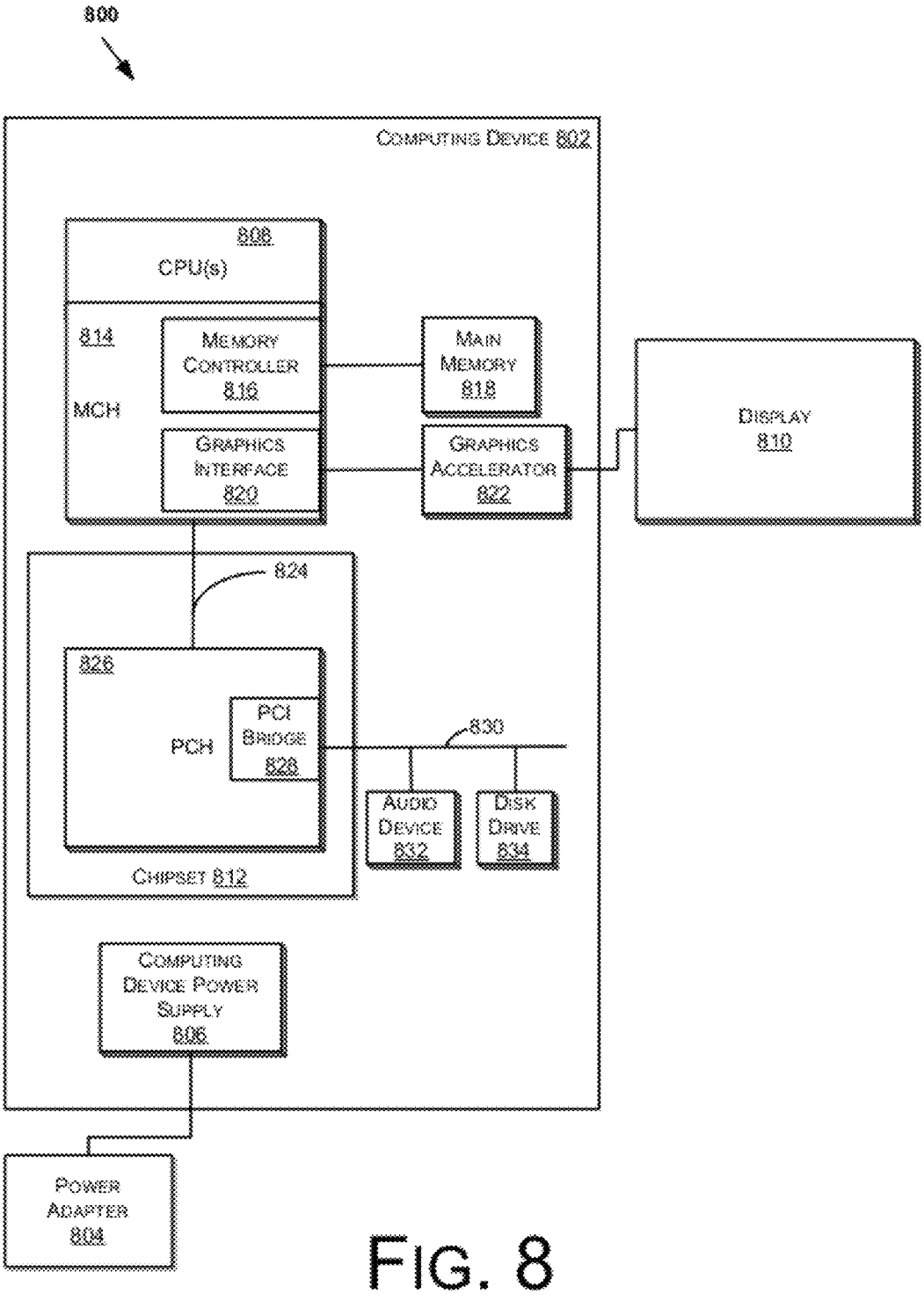
FIG. 8 is a schematic illustration of a computing system which may be adapted to include an integrated antenna assembly, according to some embodiments.

FIG. 8 is a schematic illustration of a computer system 800 which may include a wireless communication capability in accordance with some embodiments. The computer system 800 includes a computing device 802 and a power adapter 804 (e.g., to supply electrical power to the computing device 802). The computing device 802 may be any suitable computing device such as a laptop (or notebook) computer, a personal digital assistant, a desktop computing device (e.g., a workstation or a desktop computer), a rack-mounted computing device, and the like.

Electrical power may be provided to various components of the computing device 802 (e.g., through a computing device power supply 806) from one or more of the following sources: one or more battery packs, an alternating current (AC) outlet (e.g., through a transformer and/or adaptor such as a power adapter 804), automotive power supplies, airplane power supplies, and the like. In some embodiments, the power adapter 804 may transform the power supply source output (e.g., the AC outlet voltage of about 110 VAC to 240 VAC) to a direct current (DC) voltage ranging between about 7 VDC to 12.6 VDC. Accordingly, the power adapter 804 may be an AC/DC adapter.

The computing device 802 may also include one or more central processing unit(s) (CPUs) 808. In some embodiments, the CPU 808 may be one or more processors in the Pentium® family of processors including the Pentium® II processor family, Pentium® III processors, Pentium® IV, or CORE2 Duo processors available from Intel® Corporation of Santa Clara, Calif. Alternatively, other CPUs may be used, such as Intel's Itanium®, XEON™, and Celeron® processors. Also, one or more processors from other manufactures may be utilized. Moreover, the processors may have a single or multi core design.

A chipset 812 may be coupled to, or integrated with, CPU 808. The chipset 812 may include a memory control hub (MCH) 814. The MCH 814 may include a memory controller 816 that is coupled to a main system memory 818. The main system memory 818 stores data and sequences of instructions that are executed by the CPU 808, or any other device included in the system 800. In some embodiments, the main system memory 818 includes random access memory (RAM); however, the main system memory 818 may be implemented using other memory types such as dynamic RAM (DRAM), synchronous DRAM (SDRAM), and the like. Additional devices may also be coupled to the bus 810, such as multiple CPUs and/or multiple system memories.

The MCH 814 may also include a graphics interface 820 coupled to a graphics accelerator 822. In some embodiments, the graphics interface 820 is coupled to the graphics accelerator 822 via an accelerated graphics port (AGP). In some embodiments, a display (such as a flat panel display) 840 may be coupled to the graphics interface 820 through, for example, a signal converter that translates a digital representation of an image stored in a storage device such as video memory or system memory into display signals that are interpreted and displayed by the display. The display 840 signals produced by the display device may pass through various control devices before being interpreted by and subsequently displayed on the display.

A hub interface 824 couples the MCH 814 to a platform control hub (PCH) 826. The PCH 826 provides an interface to input/output (I/O) devices coupled to the computer system 800. The PCH 826 may be coupled to a peripheral component interconnect (PCI) bus. Hence, the PCH 826 includes a PCI bridge 828 that provides an interface to a PCI bus 830. The PCI bridge 828 provides a data path between the CPU 808 and peripheral devices. Additionally, other types of I/O interconnect topologies may be utilized such as the PCI Express™ architecture, available through Intel® Corporation of Santa Clara, Calif.

The PCI bus 830 may be coupled to an audio device 832 and one or more disk drive(s) 834. Other devices may be coupled to the PCI bus 830. In addition, the CPU 808 and the MCH 814 may be combined to form a single chip. Furthermore, the graphics accelerator 822 may be included within the MCH 814 in other embodiments.

Additionally, other peripherals coupled to the PCH 826 may include, in various embodiments, integrated drive electronics (IDE) or small computer system interface (SCSI) hard drive(s), universal serial bus (USB) port(s), a keyboard, a mouse, parallel port(s), serial port(s), floppy disk drive(s), digital output support (e.g., digital video interface (DVI)), and the like. Hence, the computing device 802 may include volatile and/or nonvolatile memory.

Thus, described herein is an integrated antenna assembly which may achieve high efficiency and low return loss across a frequency spectrum from 2.35 GHz to 2.6 GHz. In some embodiments the antenna assembly 100 may be formed as a component of a computer expansion card such as a PCI-E card connectable to a motherboard of an electronic device. Thus, the antenna assembly may be integrated into electronic devices, e.g., mobile computing devices or the like.

In the description and claims, the terms coupled and connected, along with their derivatives, may be used. In particular embodiments, connected may be used to indicate that two or more elements are in direct physical or electrical contact with each other. Coupled may mean that two or more elements are in direct physical or electrical contact. However, coupled may also mean that two or more elements may not be in direct contact with each other, but yet may still cooperate or interact with each other.

Reference in the specification to "one embodiment" or "some embodiments" means that a particular feature, structure, or characteristic described in connection with the embodiment is included in at least an implementation. The appearances of the phrase "in one embodiment" in various places in the specification may or may not be all referring to the same embodiment.

Although embodiments have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. An antenna assembly, comprising:

a computer expansion card mounted adjacent a printed circuit board and comprising a metallic layer which forms a radiating element comprising a first part which is a printed layer and a second part which extends to a metallic shield, wherein the computer expansion card comprises:

a first mounting hole disposed at a first corner of the computer expansion card and a second mounting hole disposed at a second corner of the computer expansion card, opposite the first corner, to receive a fastener to mount the computer expansion card on the printed circuit board wherein the fastener is positioned through one of the first mounting hole or the second mounting hole and provides the feed line for the antenna assembly; and a plurality of grounding pins, at least one of which provides a connection between the radiating element on the computer expansion card and a ground plane on the printed circuit board, such that the ground plane on the printed circuit board provides a ground plane for the radiating element; and a feed line coupled to the radiating element.

2. The antenna assembly of claim 1, wherein:

the computer expansion card measures between 35.00 and 60.00 millimeters in length and between 25.00 and 35.00 millimeters in width; and the radiating element extends across the entire width and length of the expansion card.

3. The antenna assembly of claim 1, wherein:

the computer expansion card comprises a Peripheral Component Interconnect Express (PCI-E) card.

4. The antenna assembly of claim 1, wherein the antenna assembly has a resonance frequency range centered approximately at 2.5-GHz.

5. The antenna assembly of claim 1, wherein assembly is coupled to at least one of a WiFi radio or a Bluetooth radio.

6. A printed circuit board assembly, comprising:

a motherboard, a computer expansion card mounted adjacent a printed circuit board and comprising a metallic layer which forms a radiating element comprising a first part which is a printed layer and a second part which extends to a metallic shield, wherein the computer expansion card comprises:

first mounting hole disposed at a first corner of the computer expansion card and a second mounting hole disposed at a second corner of the computer expansion card, opposite the first corner, to receive a fastener to mount the computer expansion card on the printed circuit board wherein the fastener is positioned through one of the first mounting hole or the second mounting hole and provides the feed line for the antenna assembly; and a plurality of grounding pins, at least one of which provides a connection between the radiating element on the computer expansion card and a ground plane on the printed circuit board, wherein at least a portion of the motherboard defines a ground plane for the radiating element.

7. The printed circuit board assembly of claim 6, wherein:

the computer expansion card measures between 30.00 and 60.00 millimeters in length and between 25.00 and 35.00 millimeters in width; and the radiating element extends across the entire width and length of the expansion card.

8. The printed circuit board assembly of claim 6, wherein:

the computer expansion card comprises a Peripheral Component Interconnect Express (PCI-E) card.

9. The printed circuit board assembly of claim 8, wherein an RF signal is fed into the antenna via at least one of the first mounting hole or the second mounting hole.

10. The printed circuit board assembly of claim 9, wherein the radiating element has a resonance frequency range centered approximately at 2.5 GHz.

11. The printed circuit board assembly of claim 6, wherein computer expansion card is coupled to at least one of a WiFi radio or a Bluetooth radio.

12. An electronic device, comprising:

at least one radio; and an antenna assembly coupled to the at least one radio, the antenna assembly comprising:

a computer expansion card mounted adjacent a printed circuit board and comprising a metallic layer which forms a radiating element comprising a first part which is a printed layer and a second part which extends to a metallic shield, wherein the computer expansion card comprises:

first mounting hole disposed at a first corner of the computer expansion card and a second mounting hole disposed at a second corner of the computer expansion card, opposite the first corner, to receive a fastener to mount the computer expansion card on the printed circuit board wherein the fastener is positioned through one of the first mounting hole or the second mounting hole and provides the feed line for the antenna assembly; and a plurality of grounding pins, at least one of which provides a connection between the radiating element on the computer expansion card and a ground plane on the printed circuit board, such that the ground plane on the printed circuit board provides a ground plane for the radiating element, wherein an RF signal is fed into the antenna assembly via one of the mounting holes.

13. The electronic device of claim 12, wherein:

the computer expansion card measures between 30.00 and 60.00 millimeters in length and between 25.00 and 35.00 millimeters in width; and the radiating element extends across the entire width and length of the expansion card.

14. The electronic device of claim 12, wherein:

the computer expansion card comprises a Peripheral Component Interconnect Express (PCI-E) card.

15. The electronic device of claim 12, wherein the antenna assembly has a resonance frequency range centered approximately at 2.5 GHz.

16. The electronic device of claim 12, wherein the antenna assembly is coupled to at least one of a WiFi radio or a Bluetooth radio.

* * * * *